United States Patent [19]

Samuelsson

[11] Patent Number: 4,728,138

[45] Date of Patent: Mar. 1, 1988

[54] AUTOMATICALLY ACTING, LOCKABLE HOISTING BLOCK

[76] Inventor: Mats Samuelsson, Selebovägen 23, S-122 48 Enskede, Sweden

[21] Appl. No.: 33,158

[22] PCT Filed: Jun. 4, 1986

[86] PCT No.: PCT/SE86/00259

§ 371 Date: Feb. 3, 1987

§ 102(e) Date: Feb. 3, 1987

[87] PCT Pub. No.: WO86/07343

PCT Pub. Date: Dec. 18, 1986

[30] Foreign Application Priority Data

Jun. 5, 1985 [SE] Sweden ..... 8502782
Jan. 22, 1986 [JP] Japan ..... 61-12943

[51] Int. Cl.[4] ..... B66C 1/12
[52] U.S. Cl. ..... 294/82.12; 254/391
[58] Field of Search ..... 294/82.12, 74; 254/391, 254/392

[56] References Cited

U.S. PATENT DOCUMENTS

| | | | |
|---|---|---|---|
| 1,389,514 | 8/1921 | Kestoll | 254/391 |
| 1,636,273 | 7/1927 | Baker | 254/391 |
| 4,097,083 | 6/1978 | Schwartz | 294/82.12 |

*Primary Examiner*—James B. Marbert
*Attorney, Agent, or Firm*—Kurt Kelman

[57] ABSTRACT

Automatically, alternatively manually lockable hoisting block, which is freely movable along a hoisting member extending between a load to be lifted and the block, to a desired position in relation to the load. The inventive block includes a plunger (12) actuable by at least one locking mechanism (6, 7) and a seat (20) disposed in the region of the plunger, a section of the hoisting member (30) running through a groove commonly formed by the plunger and seat such as the lockable between the plunger and seat. Hoisting may thus take place independent of the position of the block in relation to the hoisting member and the load.

12 Claims, 3 Drawing Figures

AUTOMATICALLY ACTING, LOCKABLE HOISTING BLOCK

The present invention relates to an automatically acting, lockable hoisting block for automatically and/or manually locking a lifting member running through it, the block being intended to be disposed in any attitude in relation to the load to be lifted with the aid of the lifting member.

In hoisting blocks of the prior art having automatic locking of a rope running through the block, in which the rope is attacked at both ends to a load to be lifted, locking is accomplished by a means associated with the block and turnable in relation to it, this means turning in response to tension in the rope and thus firmly clamping the rope. This type of device is described in U.S. Pat. No. 4,097,083, for example. A drawback with the known device is that the block must move along the rope until both parts of the rope have been stretched, in order to achieve locking between rope and block. A further drawback is that the locking member causes undesirable wear on the rope, with the accompanying risk of rope failure. Furthermore, the locking force ceases as soon as the load in one rope part comes against an obstruction and ceases to weigh down on this part. SE 169 695 describes another hoisting block of the self-adjusting type. In this device the lifting means includes a saddle member, which has in cross section a V-shaped groove in which the lifting rope is intended to run. The shape of the groove causes it to engage against the rope to avoid the rope slipping. This arrangement has the result that the block is very difficult to adjust in relation to the rope, and several adjustments of rope to block will be necessary before hoisting may be performed. Here as well, both rope parts must be loaded for the rope to become locked. The object of the present invention is to provide a hoisting block not having the drawbacks mentioned and which, with automatic and/or manual action, is lockable in an adjustable position in any attitude in relation to the load to be hoisted. With the inventive hoisting block, hoisting may also take place even when the load is not in a position of equilibrium, and when the different parts of the hoisting member are unequally loaded. This also means that one of the parts can be completely unloaded during hositing with the inventive block.

The distinguishing features of the present invention are apparent from following claims.

Figure 1:
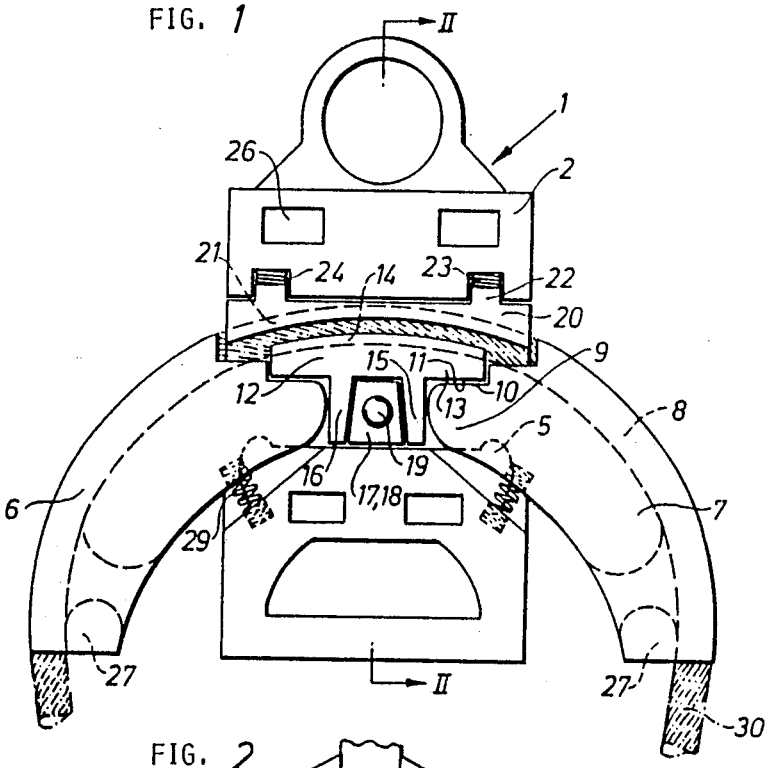
Figure 2:
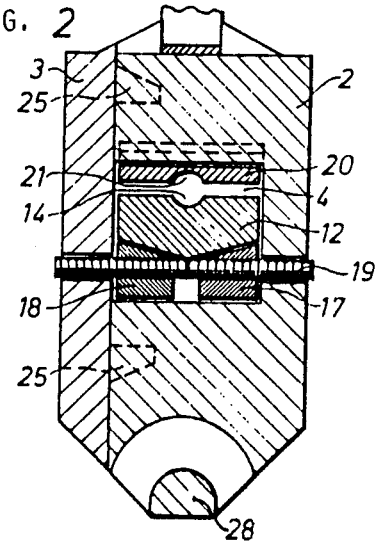
Figure 3:
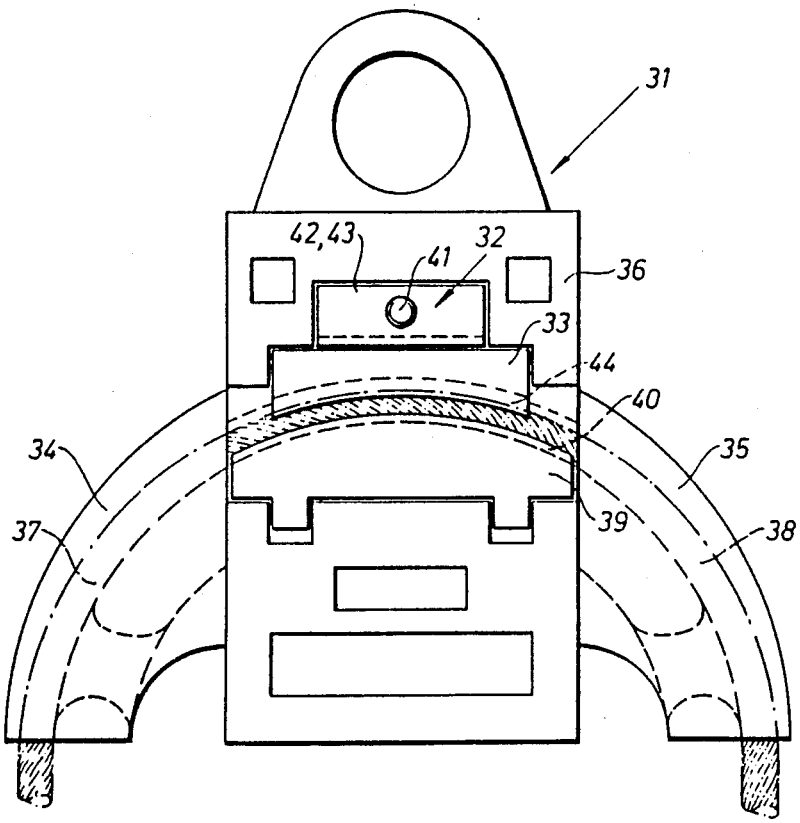

The invention will now be described with reference to the accompanying drawings illustrating an embodiment of the inventive hoisting block, and where FIG. 1 is a schematic elevation of a first embodiment of the inventive hoisting block, with a frontcover removed, FIG. 2 is a cross section through the block of FIG. 1, FIG. 3 is a schematic elevation of a second embodiment of the hoisting block in accordance with the present invention with the front cover removed.

A first embodiment of an inventive hoisting block is illustrated in FIG. 1, the block being intended for coupling to an unillustrated hook on a hoisting crane or any other hoisting means. The inventive block 1 comprises a main block 2 with an associated cover 3, the function of which will be explained later. The main block 2 is configurated in its cross section as a substantially U-shaped part with horizontal legs between which there is formed a recess or opening 4 for accommodating the mechanism locking a cable, rope, band, chain or any other hoisting member. A pair of lugs 5 or the like, attached to the block 2 form fulcra for arms 6,7 which are turnable relative the block. The lugs 5 engage in recesses, not shown in more detail, in the arms 6,7. Since the arms are alike, the description of them will be confined to the right arm in FIG. 1. The arm 7 has an elongate curved configuration in a vertical plane, and is provided with bearing surface 8 in its longitudial direction. A rope, band or similar hoisting member 30 can run freely over the surface 8, which is its transverse direction is defined by projection flanges or the like forming walls on the arm. When the hoisting member is a rope, chain or the like, the bearing surface may have in cross section a curved shape of any radius of curvature. What is essential is that the hoisting member does not slip out of the arm in case of a skew hoist. It is also conceivable within the scope of the invention to make the surface 8 entirely flat when the hoisting member has the shape of a wide, flat band or belt. The arm 7 van thus form a saddle-shaped support for the rope 30 running between the block 1 and the load. The end 9 of the arm 7 in the vicinity of the lug 5 is in contact via a shoulder 10 with the inner side 11 of a support 13 associated with a plunger 12. The upper side of the plunger 12, which has a curved configuration, has a bearing surface 14 of approximately the same configuration as that of the bearing surface 8, and which is substantially a continuation of the bearing surface 8 of the respective arm, thus bridging between the bearing surfaces of the two arms. The lower portion of the plunger 12 is provided with downwardly tapering guide lugs 15,16, between which there are arranged conical locking members 17,18 for manually locking the hositing member. These locking members 17,18 are displaceable to and from each other in a horizontal plane with the aid of a bolt 19, not illustrated in more detail. There may be some play between the plunger guide lugs 15,16 and the locking members 17,18, in order to allow the plunger to pivot slightly in a plane radial to the bolt 19. The arms are thus allowed to pivot freely about their respective lugs 5 in mutual independence. The downwardly tapering shape of the guide lugs and the conical shape of the locking members ensures that the plunger cannot bind against the locking members. Above the plunger 12 there is a seat 20 movably disposed in the block. The seat downwardly has a concave surface, seen from below, which in its longitudinal direction is provided with an open bearing surface or a groove 21. The surface 21 of the seat 20 forms a common groove together with the plunger bearing surface 14 in which the hoisting member 30 may be locked. In FIG. 2, the groove commonly formed by the bearing surface 14 and the bearing surface 21 serves to accomodate a rope, chain or the like hoisting member. In the case where the latter is a wide band or the like it is obvious that the common groove forms a larger part of the opening or recess 4, defined by the vertical walls of the block and the respective surface on the plunger and seat. Since the surfaces 14,21 are substantially flat, the entire surfaces of the plunger and seat engage against the band in question.

The seat is upwardly provided with guide lugs 22 which are engaged with the block via compression springs 23 or the like via recesses 24 made in it. The guide lugs 22 may be given any configuration, e.g. a dovetail shape, so that they engage with some play in the upper portion of the block to retain the seat in it. In its longitudial direction the seat extends to advantage somewhat outside the plunger 12 so that its end groove is above the end grooves of the arms 6,7.

In this way the block may be equipped with plungers of varying dimensions to suit different hoisting members. The spacing between plunger and seat should have dimensions such that a heavy chain can also find room. A cover 3, provided with a plurality of locating bosses 25 (four in the Figure) or the like is fitted with not shown fastening means to the block with the aid of complementary recesses 26. The cover contributes in distributing more uniformly over the block the forces occurring during hoisting.

Each arm 6,7 may be provided at its outer free end with a stirrup 27 for a hook or the like. The main block may also be formed with a stirrup means 28 for hoisting hook. Furthermore, each arm may be covered by a casing or the like, fastened to the block for protecting the upper side of the arm and the hoisting member as well as the plunger and seat.

The automatically acting inventive block in accordance with the invention for locking a hoisting member functions in the following way:

The hoisting member 30 is attached at one or preferably both ends to a load which is to be hoisted, and the member is allowed to run through the block so that it rests in the channels of the arms 6,7 and the grooves of the plunger 12, at the same time running in the groove commonly formed between the plunger 12 and seat 20. When the block is raised, one or both of the arms 6,7 will pivot under the action of the hoisting member and the load about the lugs 5, the arm 6 turning in a counterclockwise direction and arm 7 in a clockwise direction in the example illustrated in FIG. 1. Whether just one or both arms actuate the plunger locking movement against the seat depends on the position of the block in relation to the hoisting member and also on whether just one or both ends of the hoisting member take up the load. When the block is close to one end of the member, i.e. near the load which is to be lifted, the member will be locked in the block between the plunger and the seat under the action of only one of the arms. In certain cases it may be advantageous to hoist the load in this way. If another position of the block in relation to the hoisting member and load is desired the block may be pushed manually along the member, for hoisting once again. Essential to the hoisting block in accordance with the invention is thus that locking the hoisting member takes place just as effectively with one arm activated or both arms simultaneously. In turn this means that only one of the ends of the hoisting member needs to be fastened to the load. Via the shoulder 10 of one or both arms the plunger 12 and the section of the hoisting member on it are forced to move upwards against the spring biassed seat 20 to that the member is locked in the groove formed between the plunger and seat. The groove may advantageously be formed so that it functions as a supplementary lock, e.g. it could be made slightly conical. The load may now be hoisted without fear of the hoisting member slipping. As already mentioned, in some cases it may be desirable that a load has a certain inclination when it is to be hoisted. In these cases the inventive hoisting block is allowed to run along the hoisting member up to the point where hoisting is performed most advantageously. The block is locked in this position in the same way as described above as soon as one of the hoisting member parts has been stretched. It is also possible to lock the block manually with the locking members 17,18 by moving them towards each other by turning the left- and right-hand threaded bolt 19. The locking members can also act as an extra safety lock working with the automatic lock, the plunger 12 being locked by the locking members 17,18 after having been moved to the position in which it is to be locked. Compression springs 29 may be arranged between the arms 6,7 and the main block 2, whereby the sliding ability of the block along the hoisting member 30 may be regulated.

In connection with FIG. 3, an alternative embodiment of the inventive hoisting block is illustrated. This block 3 is also self-adjusting in relation to an optional type of hoisting member, inasmuch as it can be moved to a position best suited to the load hoisted. As distinct from the automatically lockable hoisting block described in connection with FIGS. 1 and 2 above, this emodiment includes a plunger actuable by a manual locking mechanism 32. In this purely manually lockable block, both arms 34,35 are firmly fixed to the main block 36, thus forming one common unit. Similar to the arms 6,7 the arms 34,35 are provided with elongate bearing surfaces 37,38 similar to those described in connection with FIGS. 1 and 2, for supporting a suitable hoisting member. Similar to the plunger 12, the plunger 33 is formed with a bearing surface 44 for the hoisting member and under the action of the manual locking mechanism 32 it is movable downwards towards a seat 39, this also being provided with a bearing surface 40 similar to the previously described surface 21. The manually operated locking mechanism comprises two locking members 42,43, which are displaceable from and to each other in a horizontal plane under the action of a left- and right-hand threaded bolt 41. Locking a hoisting member running freely through the block is achieved manually by the locking members being urged towards each other through the agency of the bolt 41 so that their sloping surfaces press the plunger 33 against the seat 39, the member between the plunger and seat thus being securely locked. In order that the force required to move the piston towards the seat will not be too large when a very heavy load is to be hoisted, the plunger is disposed above the seat 39 so that the force transferred from the load to the hoisting member is transferred to the seat and not to the movable plunger. The manual hoisting block otherwise conforms with the automatically acting hoisting block of FIGS. 1 and 2 with respect to the seat spring suspension, a cover fitable to the main block and the extra stirrup fastenings. With this block hoisting can also be carried out in any position relative the hoisting member, in turn resulting in that the load on one arm may greatly differ from the load on the other. It is thus possible with the inventive block to hoist a load fastened only to one part of the hoisting member.

The parts associated with the different blocks, i.e. the plunger, seat and arms, may be manufactured as assemblable sets for different groove dimensions, thus enabling the use of hoisting members having different dimensions. Exchanging such a set merely requires removal of the cover 3 to make the parts accessible. It is also conceivable to arrange several grooves in both plunger and seat, as well as several plunger sections connected to each other in serier, i.e. sections of a plunger that are arranged one after the other in the longitudinal direction of the hoisting member, where one or more of the sections may be disposed for actuating the pivotable arms and one section for the manual locking mechanism. By connection in series is also meant here plunger sections arranged one above the other, e.g. for several like or unlike hoisting members. It is also possible to arrange plunger sections lying parallel, i.e. arranged side by side transverse the longitudinal direction of the hoisting member. The hoisting block and arms may of course have different dimensions.

The bearing surfaces of the seat 20 and the plunger 12 for the automatically lockable hoisting block as well as the bearing surfaces for the plunger 33 and seat for the manually lockable hoisting block may advatageously be provided with an antislip material to further improve the grip of the plunger and seat on the hoisting member. It is also conceivalbe to provide the arms with friction-increasing material of suitably restricted areas.

I claim:

1. A hoisting block, which is lockable and automatically acting in relation to a hoisting member, said block being freely movable along the member, which extends from a load to be moved and to the block, such that the block can assume a desired position in relation to the load, characterized in that the block includes at least one locking mechamism, said locking mechanism comprising two arms, which are pivotable in relation to the block and mutually independently, said hoisting member being arranged onto said arms, at least one plunger actuable by at least one locking mechanism, a seat disposed in the region of the plunger, a section of said hoisting member running through a groove commonly formed by the plunger and seat, said section of the hoisting member being locked between said plunger and said seat influenced by said locking mechanism.

2. Block as claimed in claim 1, characterized in that each arm is elongate and curved and has a convex upper side on which is formed a bearing surface (8) for the hoisting member, in that the arm has its free end outside the block, its other end being formed with a recess for pivoting on a lug (5) disposed on the block.

3. Block as claimed in claim 2, characterized in that said other end of the arm has an abutment (10) with an upper surface suitably formed for the purpose which is in contact with the underside of an extended portion (13) of the plunger (12).

4. Block as claimed in claim 3, characterized in that the plunger is disposed in a region between said other ends of the arms, in that the plunger has an upper curved surface which is convex as seen from above, in which there is provided a groove (14) adapted to the hoisting member and oriented such that it constitutes a communicating groove between the bearing surfaces (8) of both arms (6,7).

5. Block as claimed in claim 4, characterized in that the seat (20) has a concave lower surface complementary to the convex surface of the plunger the former surface being provided with a groove (21) adapted to the hoisting medium.

6. Block as claimed in claim 4, characterized in that on its side facing away from the grooved side the plunger (12) has guide members (15,16), between which there is a plunger guide means.

7. Block as claimed in claim 6, characterized in that the plunger guide means comprises two slopingly cut locking members (17,18) which are shiftable to and from each other for manual locking of the hoisting member between plunger and seat.

8. Block as claimed in claim 7, characterized in that each arm (6,7,34,35) is provided with a stirrup means (27) at its free end.

9. Block as claimed in claim 8, characterized in that it comprises a substantially U-shaped part in its transverse direction, this part having horizontal legs, and in that the plunger, seat and/or arms are exchangeably mounted in the region between the legs, which are in mutual force transferring communication via a cover (3).

10. Block as claimed in claim 9, characterized in that in its lower horizontal leg it is provided with a further stirrup (28).

11. Block as claimed in claim 1, characterized in that the plunger comprises plunger sections arranged in series in either the vertical or horizontal direction of the block.

12. Block as claimed in claim 1, characterized in that the plunger comprises plunger sections arranged in parallel in the transverse dirction of the block.

* * * * *